US006149015A

United States Patent [19]

Aikawa

[11] Patent Number: 6,149,015

[45] Date of Patent: Nov. 21, 2000

[54] SCREEN APPARATUS FOR PAPERMAKING MATERIAL

[75] Inventor: Yoshihiko Aikawa, Shizuoka, Japan

[73] Assignee: Aikawa Iron Works Co., Ltd., Shizuoka, Japan

[21] Appl. No.: 09/318,258

[22] Filed: May 25, 1999

[30] Foreign Application Priority Data

Apr. 23, 1999 [JP] Japan ..... 11-115853

[51] Int. Cl.[7] ..... B07B 1/04

[52] U.S. Cl. ..... 209/273; 209/17; 209/283; 209/300; 162/55; 162/251; 210/415

[58] Field of Search ..... 209/17, 273, 274, 209/281, 283, 300, 305, 306; 162/4, 55, 251, 261, 380; 210/413, 414, 415

[56] References Cited

U.S. PATENT DOCUMENTS 5,435,444 7/1995 Satomi ..... 210/415 X
5,798,025 8/1998 Iwashige ..... 209/273 X

FOREIGN PATENT DOCUMENTS 1303117 10/1997 Germany ..... 209/273

*Primary Examiner*—Tuan N. Nguyen
*Attorney, Agent, or Firm*—Kanesaka & Takeuchi

[57] ABSTRACT

A screen apparatus is formed of a tank for receiving a papermaking material, a cylindrical first screen for partitioning the tank into a first chamber and a second chamber, an annular second screen disposed in the first chamber, and a rotating member disposed in the first chamber. The first screen has a closed end at one side, an open end at the other side, and a plurality of first openings in a circumferential portion thereof. The annular second screen has second openings in a plate portion and a large opening at the center thereof. The annular second screen is disposed adjacent to the first screen at the side of the closed end, and the rotating member faces the large opening of the second screen and the closed end of the first screen. Also, the rotating member includes first agitating members facing the second screen, and second agitating members facing the second screen. When the papermaking material is supplied to the first chamber, foreign materials contained in the papermaking material are removed by the first and second screens, and refined papermaking material is discharged through the second chamber. Clinging and crushing of the foreign materials can be prevented.

9 Claims, 9 Drawing Sheets

SCREEN APPARATUS FOR PAPERMAKING MATERIAL

BACKGROUND OF THE INVENTION AND RELATED ART STATEMENT

The present invention relates to a screen apparatus for refining a papermaking material, wherein clinging and crushing, i.e. pulverization, of foreign materials contained in the papermaking material can be prevented.

Heretofore, as an apparatus with a plurality of screens for separating and treating foreign materials contained in a papermaking material, i.e. old paper, for example, Japanese Patent Publication (KOKOKU) No. 59-32594 may be mentioned.

In a pressure type papermaking composite screen disclosed in the above Japanese Patent Publication, there is no problem when a papermaking material which has been pre-treated to remove certain large foreign materials, such as vinyl sheets and strings, is fed to the pressure type composite screen.

However, in case the papermaking material containing the certain large foreign materials, such as vinyl sheets and strings, without the pre-treatment is subjected to a treatment by the pressure type papermaking composite screen, the foreign materials contained in the papermaking material are clung to a rotating center portion of impellers, since the impellers are located in front of a screen through which the papermaking material passes first, and openings are provided across the screen except for a portion through which a main shaft for rotating the impellers is provided, so that the papermaking material flows toward the openings.

If the foreign materials cling to the center portion of the impellers, there is a problem such that the foreign materials are crushed or pulverized by the impellers, so that the crushed foreign materials are contained in good fibers in the papermaking material to thereby have to remove the crushed foreign materials in a later step.

In view of the above, the present invention has been made, and an object of the invention is to provide a screen apparatus, wherein clinging of foreign materials and crushing thereof can be suppressed or prevented to thereby refine a papermaking material.

Another object of the invention is to provide a screen apparatus as stated above, wherein refining effects can be increased.

Further objects and advantages of the invention will be apparent from the following description of the invention.

SUMMARY OF THE INVENTION

In order to attain the above object, a screen apparatus according to a first aspect of the present invention comprises: a tank for receiving a papermaking material to separate foreign materials from the papermaking material; a supply path for supplying the papermaking material into the tank; a cylindrical first screen for partitioning the tank into a first chamber and a second chamber, the first screen having a closed end at one side, an open end at the opposite side, and a plurality of first openings on a circumferential surface thereof; an annular second screen disposed in the first chamber and having an inner circumferential edge with a large or center opening, an outer circumferential edge, and second openings formed in a plate portion between the inner and outer circumferential edges for separating the foreign materials from the papermaking material received in the first chamber, the closed end of the cylindrical first screen facing the large opening of the second screen without facing the second openings of the second screen; a rotary shaft provided in the tank; a rotating member fixed to the rotary shaft and facing the large opening of the second screen and the closed end of the first screen; a plurality of first agitating members attached to the rotating member to face the second openings; a plurality of second agitating members attached to the rotating member substantially parallel to a longitudinal direction of the rotary shaft, the second agitating members being positioned outside the cylindrical first screen to face the first openings and extending through the large opening of the second screen; a first discharging path positioned in the first chamber on an upper stream side relative to the second screen to discharge the foreign materials contained in the papermaking material to the outside of the tank; a second discharging path positioned in the first chamber on a downstream side relative to the second screen to discharge the foreign materials which have passed through the second screen and do not pass through the first screen to the outside of the tank; and a third discharging path connected to the second chamber to discharge the papermaking material having passed through the second screen and the first screen to the outside of the tank.

Also, according to a second aspect of the screen apparatus of the present invention, in the screen apparatus of the first aspect, the rotating member is disposed to face the whole closed end of the cylindrical first screen and a part of the second screen near the inner circumferential edge of the second screen, and a plurality of papermaking material preventing members is formed at the rotating member facing the second screen to prevent the papermaking material from entering into the portion where the rotating member faces the second screen.

In addition, according to a third aspect of the screen apparatus of the present invention, in the screen apparatus of the first aspect, the rotating member is disposed to face the whole closed end of the cylindrical first screen and a part of the second screen near the inner circumferential edge of the second screen, and there is provided a plurality of papermaking material preventing members for preventing the papermaking material from entering into the portion where the second screen faces the rotating member. The papermaking material preventing members are provided to the rotating member in an inclined state such that an outer tip of each papermaking material preventing member at a side away from a rotating center of the rotating member is located at a delay side than an inner tip of the papermaking material preventing member near the rotating center in a rotating direction of the rotating member.

Also, according to a fourth aspect of the screen apparatus of the present invention, in the screen apparatus of the first aspect, the rotating member is disposed to face the whole closed end of the cylindrical first screen and a part of the second screen near the inner circumferential edge of the second screen; a plurality of papermaking material preventing members is provided at the rotating member facing the second screen to prevent the papermaking material from entering into the portion where the second screen faces the rotating member; and concave portions are formed at the second screen facing the papermaking material preventing members.

Also, according to a fifth aspect of the screen apparatus of the present invention, in the screen apparatus of the first aspect, the rotating member has a disc shape on which a plurality of first agitating members is integrally provided to project outwardly from an outer surface thereof. Each first agitating member is an elongated member, and one end thereof is directed to the center of the disc and the other end faces the second openings across the disc.

DETAILED DESCRIPTION OF PREFERRED EMBODIMENTS

Figure 1:
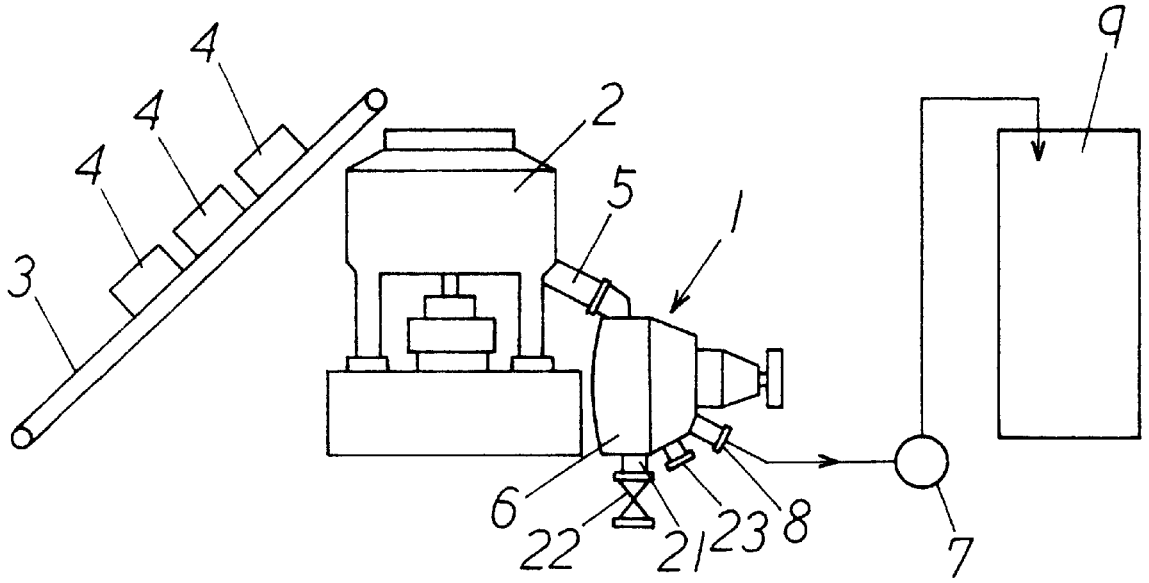
FIG. 1 is a diagram showing a screen apparatus of an embodiment according to the invention connected to other equipments.

Hereunder, a screen apparatus of an embodiment according to the present invention is described with reference to the accompanying drawings. In FIG. 1, reference numeral 1 represents a screen apparatus for removing foreign materials, such as plastics, vinyl sheets and strings contained in a papermaking material. The screen apparatus is used in connection with, for example, a pulper 2.

More specifically, the pulper 2 receives a papermaking material, i.e. old paper, 4 transferred by a conveyer 3, stirs the material with water, and dissociates the material. The dissociated papermaking material 4 in the pulper 2 is supplied to a tank 6 of the screening apparatus 1 through a supplying path 5, and the papermaking material 4 refined in the screening apparatus 1 is introduced into a receiving tank 9 by a pump 7 through a third discharging path 8.

Next, the screen apparatus 1 is described in detail with reference to FIGS. 2 to 9. The tank 6 receives the papermaking material to separate the foreign materials in the papermaking material, and is partitioned to a first chamber 12 and a second chamber 13 by a first cylindrical screen 11 having first openings 11*a*.

The first screen 11 separates the foreign materials contained in the papermaking material passing through a second screen 14, described later. The first screen 11 separating the tank 6 into the first chamber 12 and the second chamber 13 is closed at one end 11X, and is opened at the other end 11Y. The first screen 11 is provided with a plurality of first openings 11*a* in a circumferential surface, i.e. side surface except the one end 11X and the other end 11Y. The first openings 11*a* are formed, for example such that a cylindrical side surface has a plurality of circular holes with a diameter of 2 to 6 mm.

In the first chamber 12, there is the second screen 14 which is an annular plate member having a large or center opening 14*a* at a central portion with an inner circumferential edge 14X and an outer circumferential edge 14Y.

The second screen 14 has a plurality of second openings 14*b* throughout the plate between the inner circumferential edge 14X and the outer circumferential edge 14Y to separate the foreign materials contained in the papermaking material received in the tank 6.

The plate shape second screen 14 is formed of, for example, a flat plate provided with a plurality of circular holes having a diameter of 10 to 50 mm. Thus, the first openings 11*a* of the first screen 11 are made smaller than the second openings 14*b* of the second screen 14, so that large foreign materials are separated by the second screen 14 and then smaller foreign materials passing through the second screen 14 are removed by the first screen 11.

Figure 2:
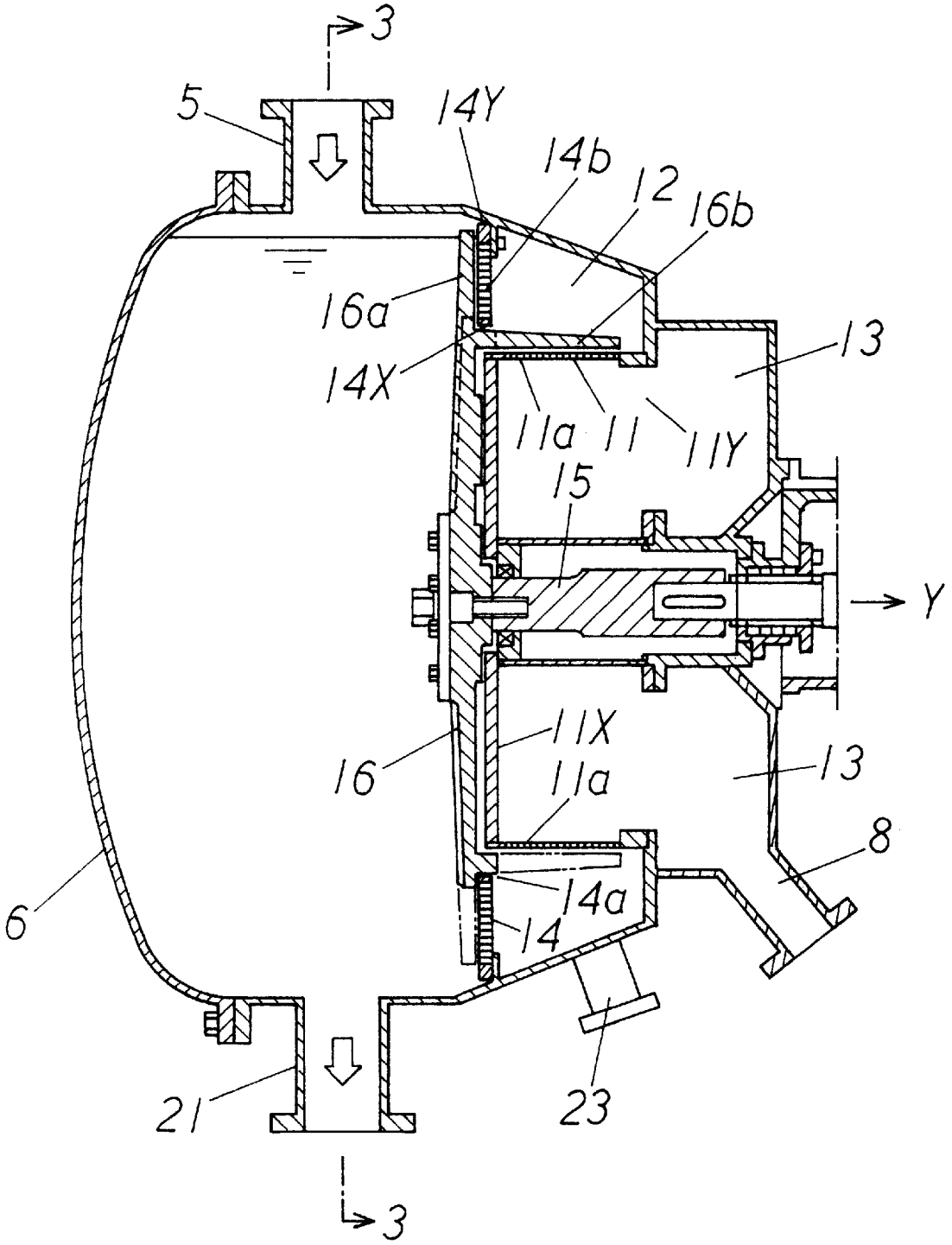
FIG. 2 is a sectional view of the screen apparatus shown in FIG. 1.

In addition, as shown in FIG. 2, the closed end 11X of the first cylindrical screen 11 is disposed to face the large opening 14*a* of the plate shape second screen 14 without facing the second openings 14*b* of the second screen 14.

Figure 9:
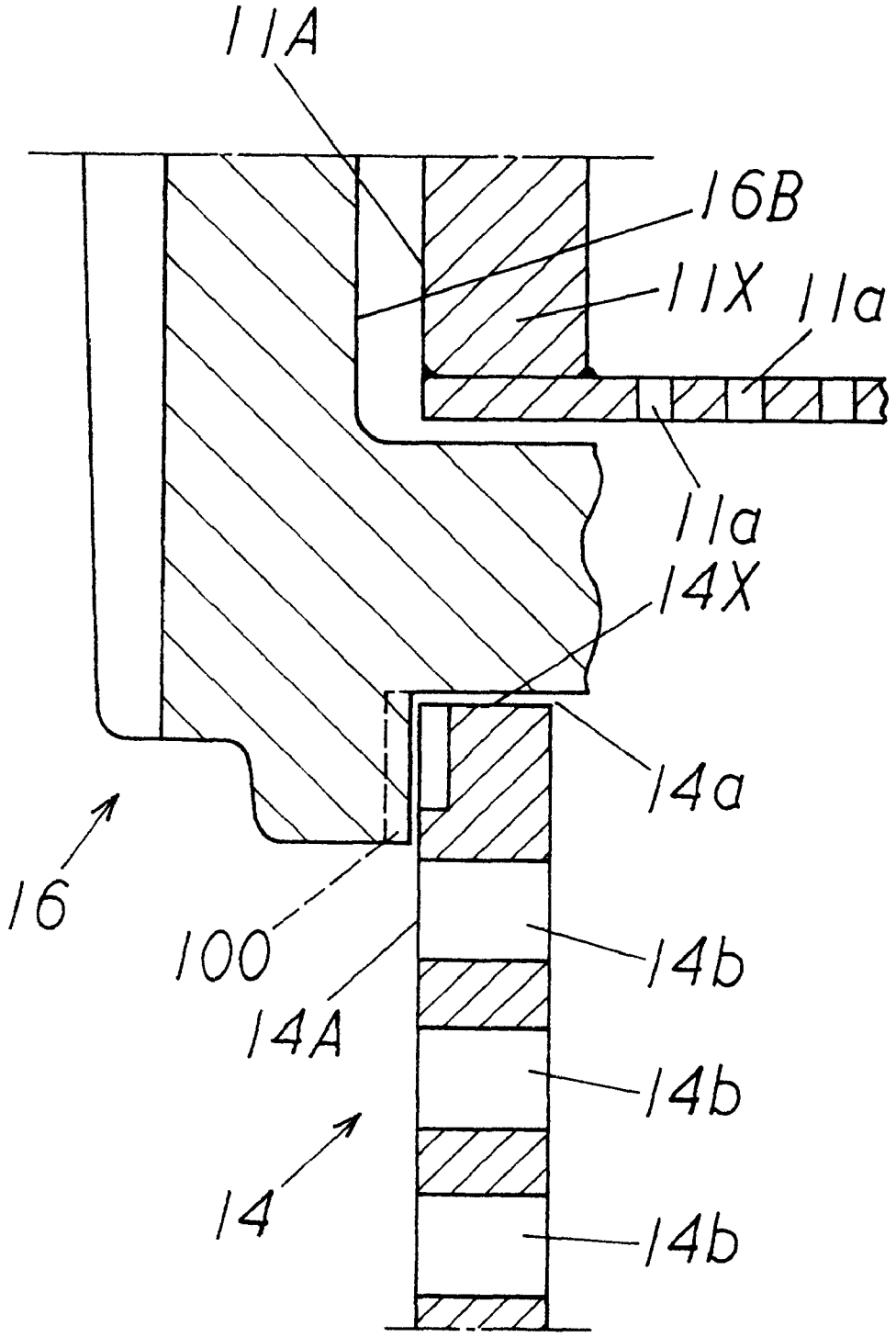
FIG. 9 is a partially enlarged sectional view of FIG. 2.

Incidentally, as shown in FIG. 9, a surface 11A of the closed end 11X of the cylindrical first screen 11 is disposed to align with a surface 14A of the second screen 14, and the closed end 11X of the cylindrical first screen 11 is formed not to project from the surface 14A of the second screen 14. However, in the present invention, the surface 11A of the closed end 11X of the cylindrical first screen 11 need not align with the surface 14A of the second screen 14, and it is sufficient that the surface 11A of the closed end 11X of the cylindrical first screen 11 is disposed not to project from the surface 14A of the second screen 14.

Also, a rotary shaft 15 driven by a motor (not shown) is provided in the tank 6 to penetrate through the closed end 11X of the cylindrical first screen 11.

The rotary shaft 15 is provided with a rotating member 16 facing the large opening 14*a* provided at the central portion of the second screen 14 and the closed end 11X of the cylindrical first screen 11. More specifically, the rotating member 16 is disposed to face the whole surface of the closed end 11X of the cylindrical first screen 11 and a part of the second screen 14 in the vicinity of the inner circumferential edge 14X of the second screen 14 (Refer to FIG. 9).

Incidentally, although a back surface 16B of the rotating member 16 does not encroach on the large opening portion 14*a* provided at the central portion of the second screen 14, as the case may be, though not shown, a part of the back surface 16B of the rotating member 16 may be disposed to enter into the large opening portion 14*a* provided at the central portion of the second screen 14.

Figure 4:
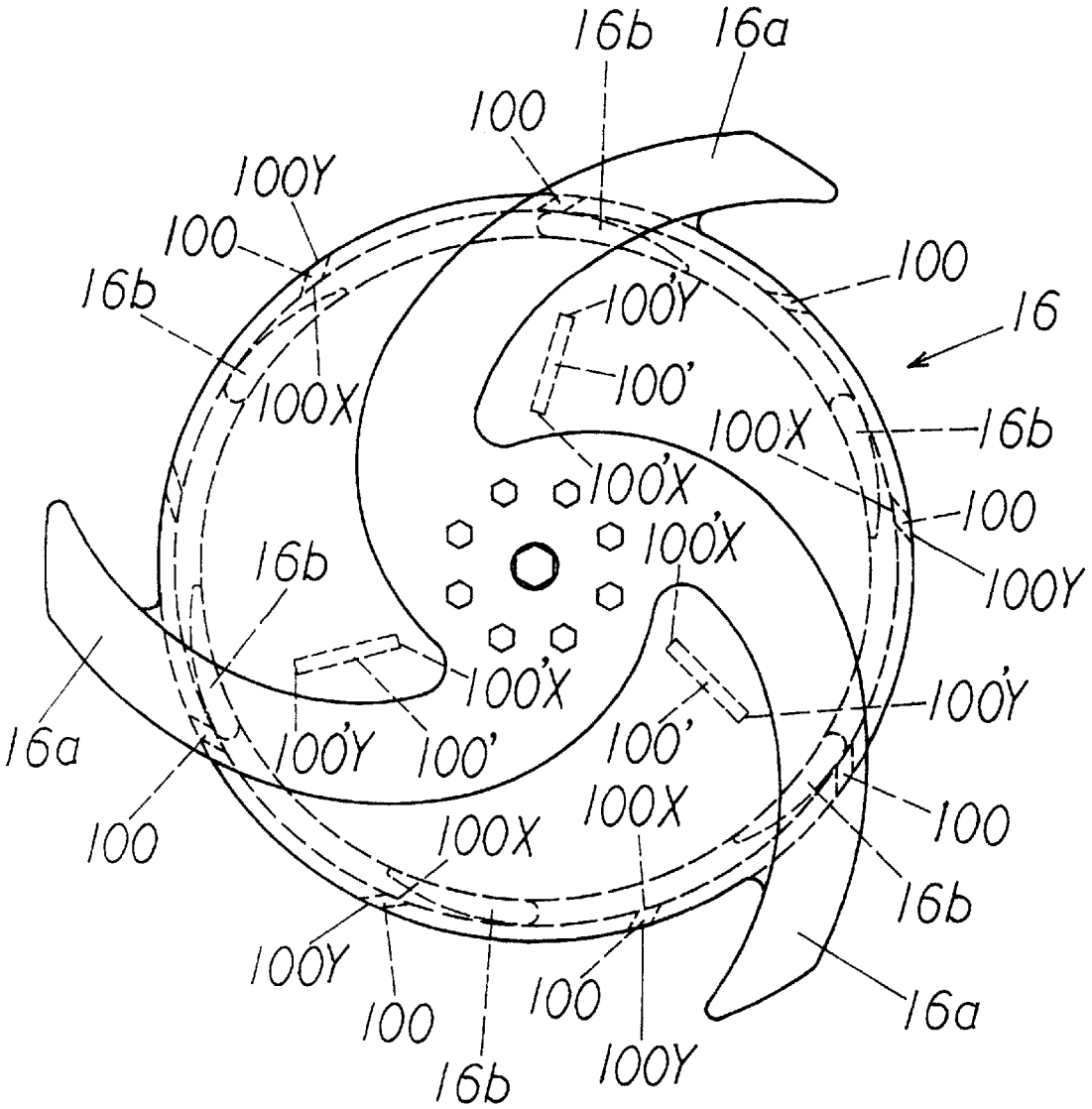
FIG. 4 is a plan view of the rotating member shown in FIG. 3.

In addition, papermaking material preventing members 100 for preventing the papermaking material from entering into a portion where the rotating member 16 faces the second screen 14, are provided at a portion of the rotating member 16 facing the second screen 14. As shown in FIG. 4, the plural papermaking material preventing members (nine members, in the present embodiment) 100 are provided at an outer circumference on a back side of the rotating member 16. The papermaking material preventing member 100 is inclined such that a forward or outer end 100Y of the papermaking material preventing member 100 on a side away from a rotary center of the rotating member 16 is delayed in the rotating direction, i.e. counterclockwise direction in FIG. 4, of the rotating member 16, than an inner end 100X of the papermaking material preventing member 100 on a side near the rotary center of the rotating member 16.

Also, a plurality of papermaking material preventing members (three members, in the present embodiment) 100' is provided at an approximately middle portion to extend radially outwardly from the rotary center of the rotating member 16 to prevent the papermaking material from entering into a portion where the rotating member 16 faces the second screen 14. The papermaking material preventing members 100' are also provided in the same manner as in the papermaking material preventing members 100 such that a forward or outer end 100'Y of the papermaking material preventing member 100' on a side away from the rotary center of the rotating member 16 is delayed in the rotating direction, i.e. counterclockwise direction in FIG. 4, of the rotating member 16, than an inner end 100'X of the papermaking material preventing member 100' near the rotary center of the rotating member 16.

As a result, the papermaking material entering into the portion where the rotating member 16 faces the second screen 14 can be prevented by the papermaking material preventing members 100, 100' provided at the portion where the rotating member 16 faces the second screen 14 to thereby prevent the foreign materials contained in the papermaking material from clinging or sticking to the portion where the rotating member 16 faces the second screen 14.

Also, a plurality of concave portions (six concaves, in the present embodiment) 14C is formed on the second screen 14 facing the papermaking material preventing members 100. Although the papermaking material can be prevented from entering into the portion where the rotating member 16 faces the second screen 14 by the papermaking material preventing members 100, in case the foreign materials, such as vinyl sheets and strings, contained in the papermaking material can not be removed and stick to the portion where the rotating member 16 faces the second screen 14, the vinyl sheets, strings or the like engage the concave portions 14C to be cut by the papermaking material preventing members 100 to thereby suppress the entanglement of the foreign materials.

Figure 3:
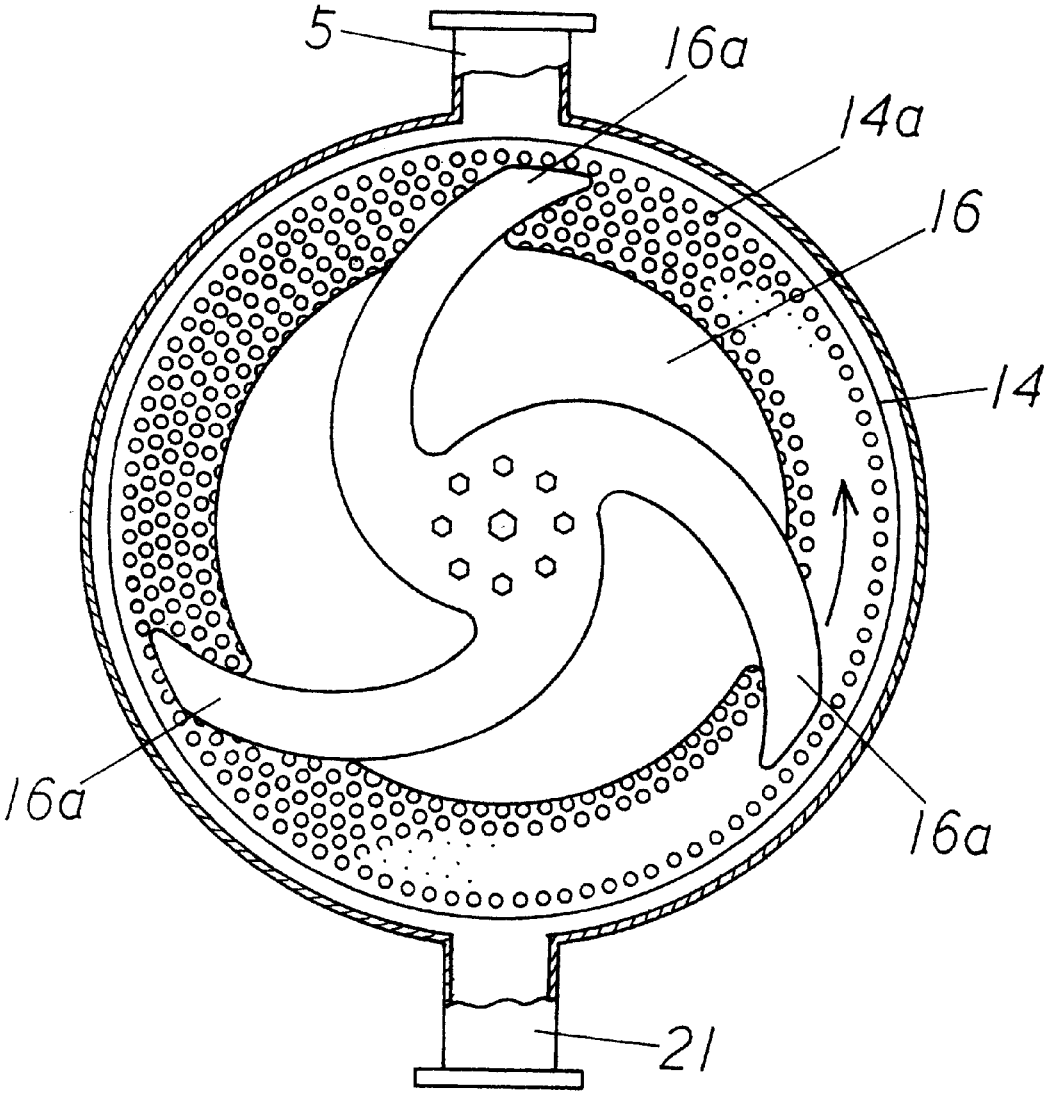
FIG. 3 is a sectional view taken along line 3—3 in FIG. 2, wherein an arrow shows a rotating direction of a rotating member.
Figure 8:
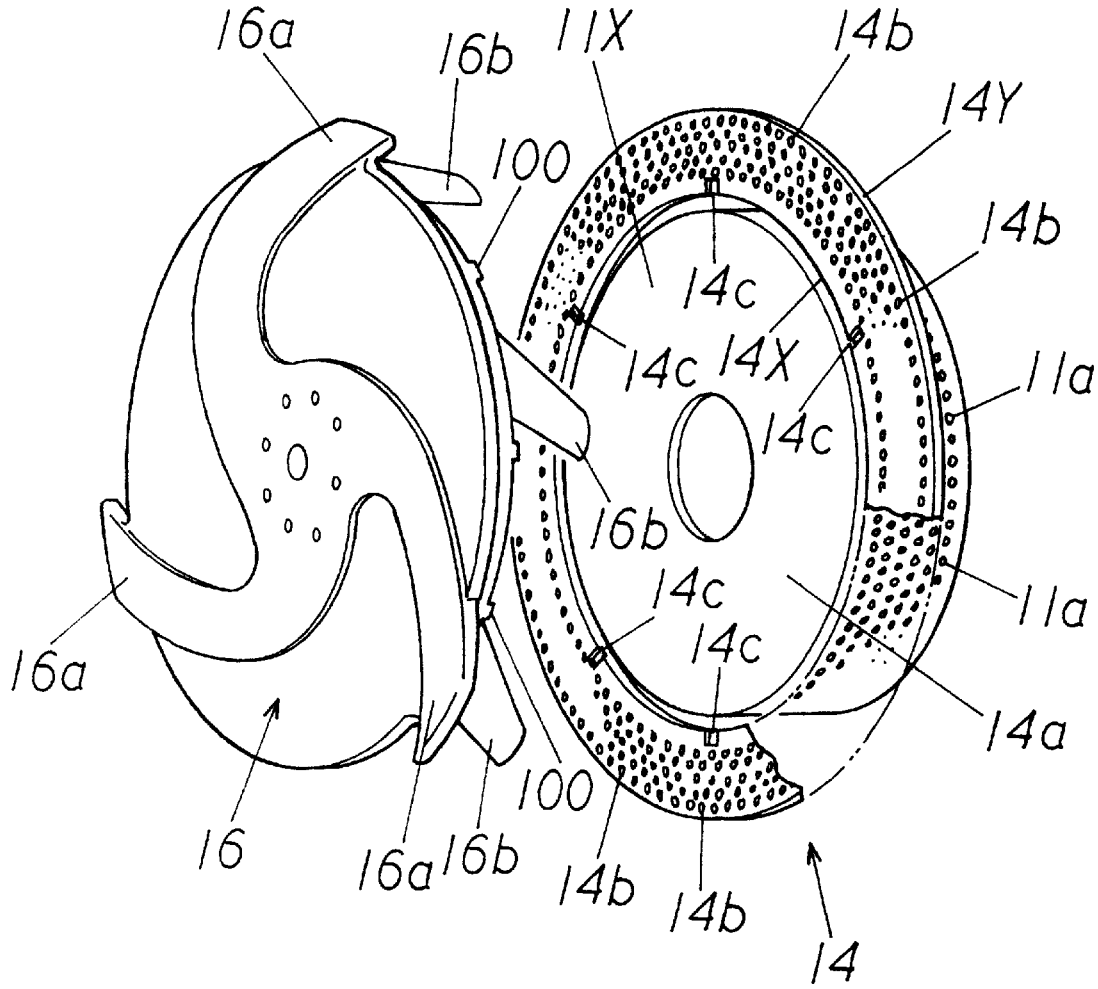
FIG. 8 is an exploded perspective view of the rotating member, first screen and second screen shown in FIG. 2.

Also, as shown in FIGS. 3, 4, 5 and 8, a plurality of first agitating members 16*a* is provided along an outer circumference of the rotating member 16. Each of the first agitating members 16*a* is provided to face the second openings 14*b* in a direction perpendicular to the longitudinal direction (Y direction in FIG. 2) of the rotary shaft 15. Incidentally, in the present embodiment, as shown in FIGS. 2, 3 and 8, the rotating member 16 has a disc shape, and the first agitating members 16*a* project outwardly from the outer surface of the disc shape rotating member 16 to be integrally fixed therewith. Each first agitating member is an elongated member, wherein one end thereof is directed to the center of the disc shape rotating member and the other end extends across the disc shape rotating member to face the second openings 14*b*. In the present embodiment, three first agitating members are provided.

As described above, since the first agitating members 16*a* are formed such that one end thereof is directed to the center of the disc shape rotating member and the other end extends across the disc shape rotating member to face the second openings 14*b*, a circulation of the papermaking material in the tank 6 can be increased to thereby prevent the papermaking material from staying in the vicinity of the second screen 14 and increase a refining effect.

Figure 5:
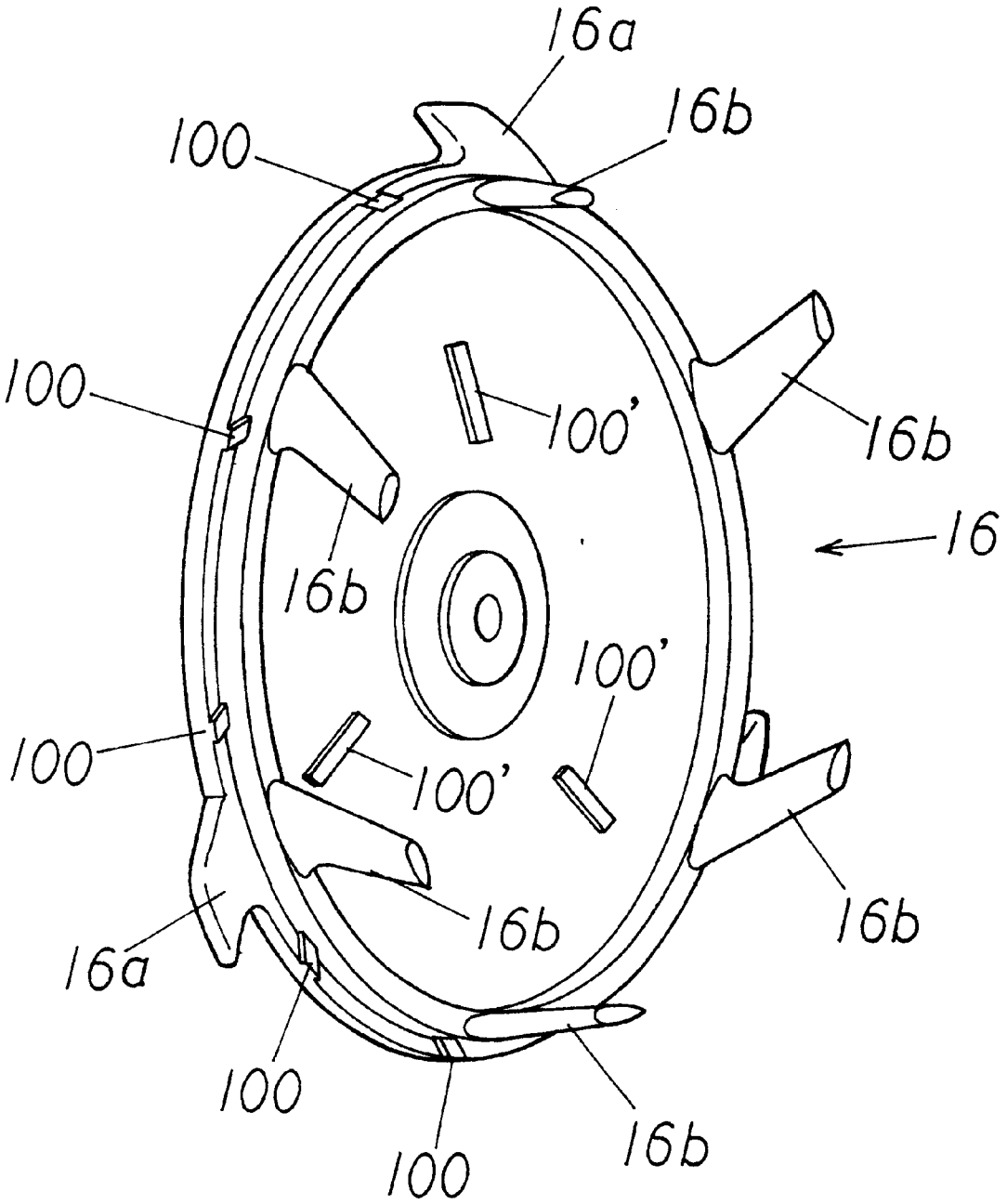
FIG. 5 is a perspective view of the rotating member of FIG. 4 viewed from a back side thereof.
Figure 6:
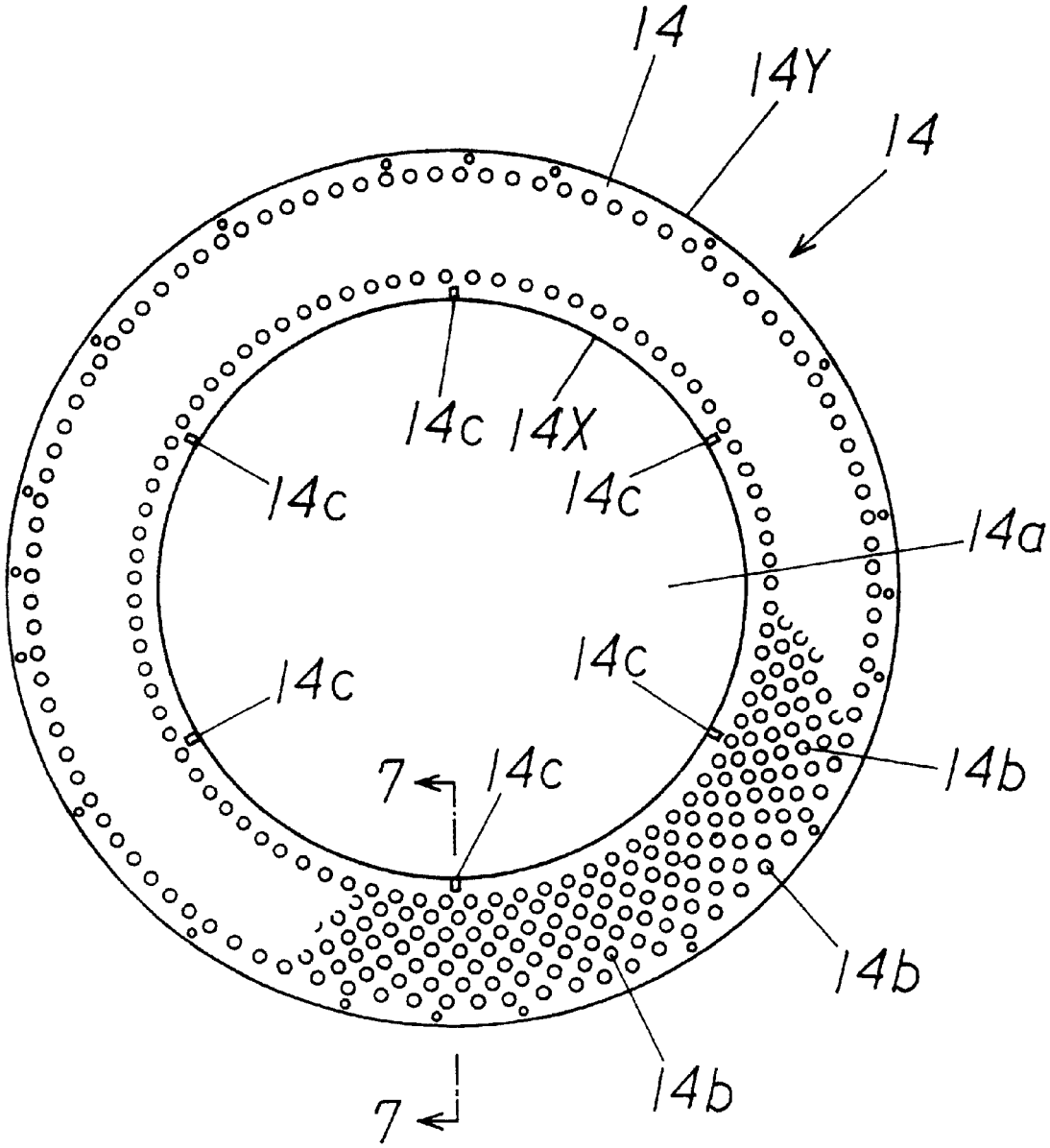
FIG. 6 is a plan view of a second screen shown in FIG. 3.
Figure 7:
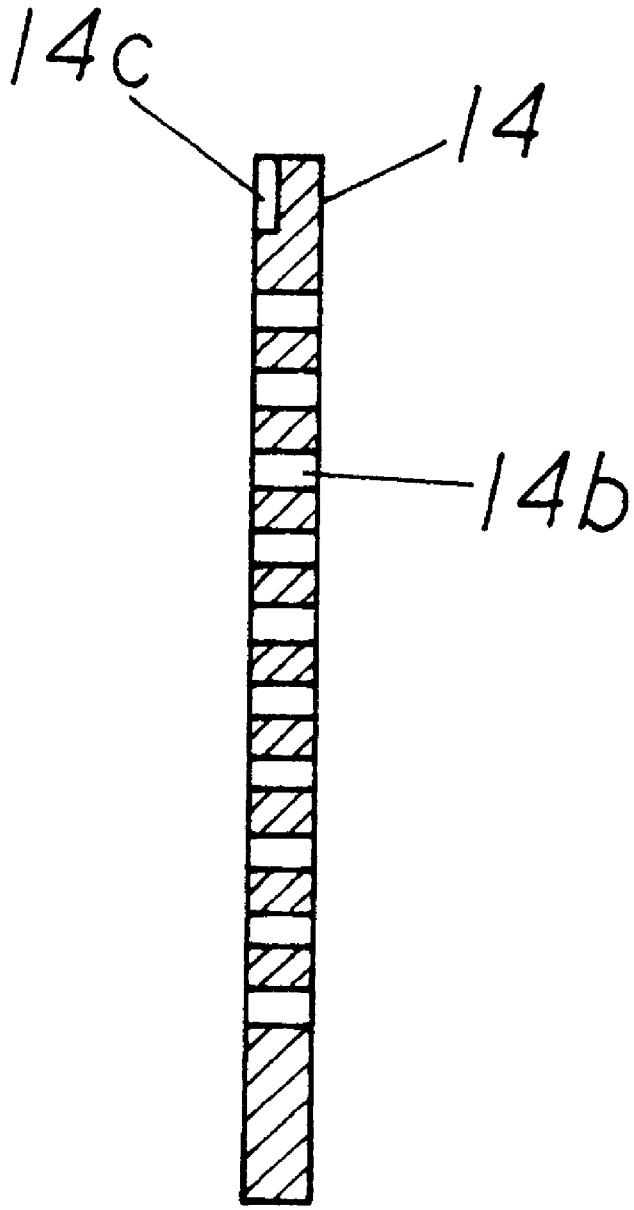
FIG. 7 is a sectional view taken along line 7—7 in FIG. 6.

Also, as shown in FIGS. 2, 5 and 8, the rotating member 16 is provided with a plurality of second agitating members 16*b*. The second agitating members 16*b* are disposed outside the cylindrical first screen 11 substantially parallel to the longitudinal direction (Y direction in FIG. 2) of the rotary shaft 15 to face the first openings 11*a*, and are provided to pass through the large opening 14*a* positioned at the center of the second screen 14.

In addition, on an upper stream side of the second screen 14 in the tank 6, there is provided a first discharging path 21 for discharging the foreign materials contained in the papermaking material to the outside of the tank 6, and reference numeral 22 is a switching valve for opening and closing the first discharging path 21.

On a downstream side of the second screen 14 in the tank 6, there is provided a second discharging path 23 for discharging the foreign materials contained in the papermaking material passing through the second screen 14 but not passing through the first screen 11 to the outside of the tank 6. The second screen 14 is provided with a switching valve, not shown, for opening and closing the second discharging path 23.

A third discharging path 8 is connected to the second chamber 13, and discharges the papermaking material refined through the second screen 14 and the first screen 11 to the outside of the tank 6.

Therefore, when the papermaking material dissociated in the pulper 2 is supplied to the tank 6 through the supplying path 5, the papermaking material is agitated by the first agitating members 16*a*. Relatively large foreign materials contained therein can not pass through the second screen 14 to thereby stay on the upper stream side of the second screen 14 and be discharged through the first discharging path 21 to the outside of the tank 6.

On the other hand, the papermaking material passing through the second screen 14 is agitated by the second agitating members 16*b* provided in the tank 6. Relatively small foreign materials contained in the papermaking material can not pass through the first screen 11 to thereby stay on the upper stream side of the first screen 11 and be discharged through the second discharging path 23 to the outside of the tank 6.

As a result, the papermaking material passing through the second and first screens 14, 11 provided in the tank 6 is refined and introduced to the receiving tank 9 through the third discharging path 8 by the pump 7.

According to the screening apparatus 1, the second screen 14 is an annular member having the inner circumferential edge 14X with a large opening portion 14*a* at the center thereof and the outer circumferential edge 14Y, and is provided in the first chamber 12. The second openings 14*b* are provided in a plate portion between the inner circumferential edge 14X and the outer circumferential edge 14Y to separate the foreign materials contained in the papermaking material received in the first chamber 12. The large opening 14*a* of the second screen 14 faces the closed end 11X of the cylindrical first screen 11 and the rotating member 16. The first agitating members 16*a* are attached to the rotating member 16 to face the second openings 14*b* of the second screen 14. The first agitating members 16*a* are located on a side away from the central portion of the rotating member 16, i.e. openings through which the papermaking material passes are not provided near the rotating center of the first agitating members 16*a*. Thus, entanglement of the foreign materials contained in the papermaking material conventionally caused in the vicinity of the rotating center of the first agitating members 16*a* can be prevented to thereby prevent the crushing or pulverization of the foreign materials.

According to the first aspect of the screen apparatus of the invention, the second screen is provided in the first chamber. The second screen is an annular member having an inner circumferential edge and an outer circumferential edge with a large opening at a central portion thereof, and second openings for separating the foreign materials contained in the papermaking material received in the first chamber are provided in the screen between the inner and outer circumferential edges. The large opening of the second screen faces the closed end of the cylindrical first screen and the rotating member. The first agitating members are attached to the rotating member to face the second openings of the second screen, and are located away from a center of the rotating member. Namely, the openings through which the papermaking material passes are not provided on a side near a rotating center of the first agitating members. Therefore, the foreign materials contained in the papermaking material do not entangle at the rotating center portion of the first agitating members. Thus, the entanglement of the foreign materials contained in the papermaking material conventionally occurred at the rotating center portion can be prevented, and the papermaking material can be refined while crushing or pulverization of the foreign materials due to the entanglement is prevented.

According to the second and third aspects of the screen apparatus of the invention, in addition to the effects of the above described first aspect, since the papermaking material preventing members are provided at the portions of the rotating member facing the second screen, the papermaking material can be refined while the papermaking material can be prevented from entering into the portions where the rotating member faces the second screen to thereby prevent the foreign materials contained in the papermaking material from clinging to the portions where the second screen faces the rotating member as well as crushing or pulverization of the foreign materials due to clinging thereof.

According to the fourth aspect of the screen apparatus of the invention, in addition to the effects of the above described first aspect, since the papermaking material preventing members are provided to portions of the rotating member facing the second screen, the papermaking material can be refined while the papermaking material can be prevented from entering into the portions where the rotating member faces the second screen to thereby prevent the foreign materials contained in the papermaking material from clinging to the portions where the second screen faces the rotating member as well as pulverization or crushing of the foreign materials due to clinging thereof. Also, in case the foreign materials contained in the papermaking material entangle with portions where the rotating member faces the second screen, the foreign materials engage concave portions to be cut by the papermaking material preventing members to thereby suppress the entanglement of the foreign materials.

According to the fifth aspect of the screen apparatus of the invention, in addition to the effects of the above described first aspect, the disc shape rotating member is integrally provided with a plurality of first agitating members on the outer surface thereof. Each agitating member is an elongated member having one end directed to the center of the disc shape rotating member and the other end extending across the disc shape rotating member to face the second opening. Thus, the papermaking material in a tank is increased in its circulation by the first agitating members, and the papermaking material is prevented from staying in the vicinity of the second screen to thereby increase a refining effect of the papermaking material.

While the invention has been explained with reference to the specific embodiments of the invention, the explanation is illustrative, and the invention is limited only by the appended claims.

What is claimed is:

1. A screen apparatus for a papermaking material, comprising:

a tank for receiving a papermaking material to separate foreign materials contained in the papermaking material;

a cylindrical first screen disposed in the tank for separating the tank into a first chamber and a second chamber, said first screen having a closed end at one side, an open end at the other side and a plurality of first openings on a circumferential surface thereof;

an annular second screen disposed in the first chamber and having an inner circumferential edge to define a center opening, an outer circumferential edge, and second openings between the inner and outer circumferential edges for separating the foreign materials from the papermaking material received in the first chamber, said closed end of the cylindrical first screen facing the center opening of the second screen without facing the second openings of the second screen;

a rotating member rotatably disposed in the tank to face the center opening of the second screen and the closed end of the cylindrical first screen;

a plurality of first agitating members attached to the rotating member to face the second openings;

a plurality of second agitating members attached to the rotating member substantially parallel to an axial direction of the first screen, said second agitating members being disposed outside the cylindrical first screen to face the first openings;

a supply path connected to the tank for supplying the papermaking material into first chamber of the tank; and a discharge path connected to the tank for discharging the papermaking material passing through the first and second screens outwardly.

2. A screen apparatus according to claim 1, further comprising a rotation shaft situated in the cylindrical first screen and passing through the closed end, said rotating member being attached to the rotation shaft.

3. A screen apparatus according to claim 2, wherein said rotating member covers the closed end of the cylindrical first screen entirely and a part of the second screen near the inner circumferential edge of the second screen, and includes a plurality of papermaking material preventing members at a portion facing the second screen to prevent the papermaking material from entering into a portion where the second screen faces the rotating member.

4. A screen apparatus according to claim 3, wherein said papermaking material preventing members are inclined to the rotating member such that an outer tip of each papermaking material preventing member at a side away from a rotating center of the rotating member is located at a delay side than an inner tip of the papermaking material preventing member near the rotating center in a rotating direction of the rotating member.

5. A screen apparatus according to claim 3, wherein said second screen includes a plurality of concave portions at portions facing the papermaking material preventing members.

6. A screen apparatus according to claim 1, wherein said rotating member has a shape of a disc, said first agitating members being integrally provided with the disc to project outwardly from an outer surface thereof, each first agitating member being an elongated member, one end of which is directed to a center of the disc and the other end facing the second openings across the disc.

7. A screen apparatus according to claim 6, wherein said disc includes a plurality of blocking members at a side facing the closed end of the first screen to prevent the papermaking material from entering a center of the disc.

8. A screen apparatus according to claim 1, further comprising: a first discharging path situated on an upper stream side of the second screen in the first chamber to discharge the foreign materials contained in the papermaking material to the outside of the tank; and a second discharging path located on a downstream side of the second screen in the first chamber to discharge the foreign materials contained in the papermaking material which have passed through the second screen and do not pass through the first screen, to the outside of the tank.

9. A screen apparatus according to claim 8, wherein said second agitating members extend from the rotating member through the center opening of the second screen.

* * * * *